United States Patent [19]

Ramey

[11] 4,257,408

[45] Mar. 24, 1981

[54] CUSHIONED STRUCTURE AND METHOD OF TESTING THEREOF

[76] Inventor: Carol Ramey, 6413-1/2 Ocean Front Walk, Playa del Rey, Calif. 90291

[21] Appl. No.: 56,249

[22] Filed: Jul. 10, 1979

[51] Int. Cl.[3] ..... A61H 1/00

[52] U.S. Cl. ..... 128/32

[58] Field of Search ..... 128/32, 33, 24.1, 1 C; 46/115, 116, 117

[56] References Cited

U.S. PATENT DOCUMENTS

| | | | |
|---|---|---|---|
| 2,859,731 | 11/1958 | Sutton | 128/1 C |
| 3,137,092 | 6/1964 | Salerno | 128/1 C |
| 3,292,610 | 12/1966 | Newman | 128/1 C |
| 3,384,074 | 5/1968 | Rautiola et al. | 128/1 C |
| 3,563,229 | 2/1971 | Pertrusson | 128/1 C |
| 4,060,932 | 12/1977 | Leto et al. | 46/116 |
| 4,124,022 | 11/1978 | Gross | 128/1 C |
| 4,136,685 | 1/1979 | Ramey | 128/33 |

*Primary Examiner*—John D. Yasko

*Attorney, Agent, or Firm*—I. Morley Drucker

[57] ABSTRACT

A battery-operated vibratory cushioned structure is disclosed which includes an outer shell filled with a shredded material or fluid filler and a pocket unit having flexible walls extending inwardly from said outer shell containing a vibrating means. The pressure of the filler medium is adjusted within critical limits wherein the flexible walls of the pocket conform to the shape of the vibratory means but the pressure is insufficient to trigger the vibratory means. The vibratory means is thus also protected from the filler material and is retained in optimum orientation within the cushioning means so that it may be reliably activated by application of external, manual, pressure. An opening in the outer shell allows access into the pocket unit for servicing of the vibrating means and is provided with disengageable closure means. A method for testing of the critical pressure limits, which the cushioned vibratory structure must meet, is set forth.

23 Claims, 8 Drawing Figures

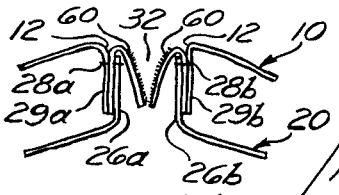
Fig. 1d
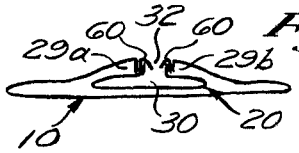
Fig. 1a
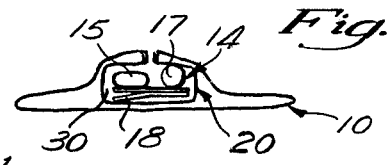
Fig. 1b
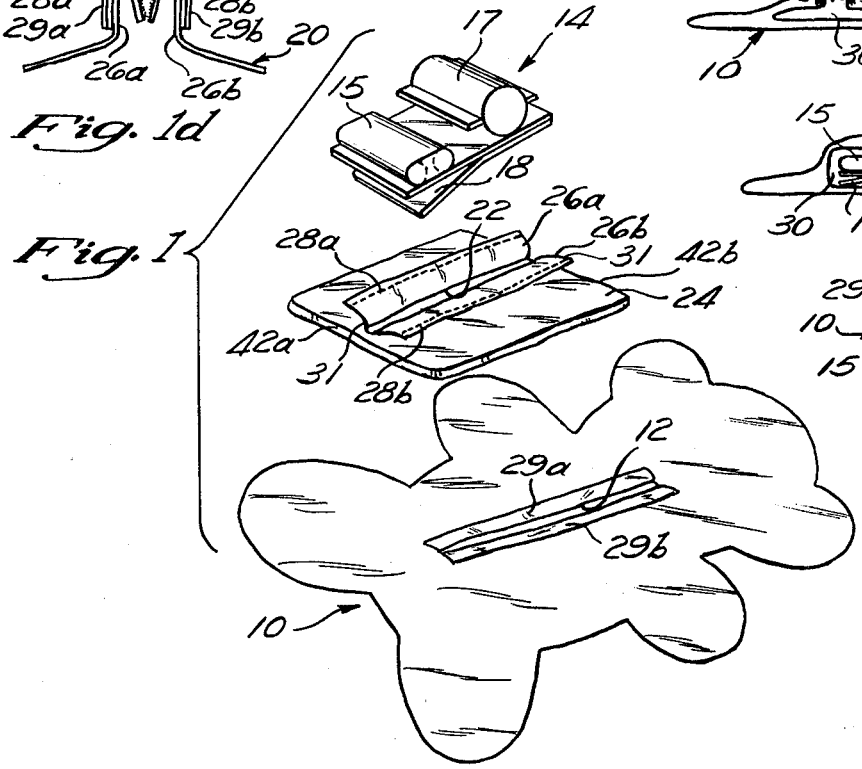
Fig. 1
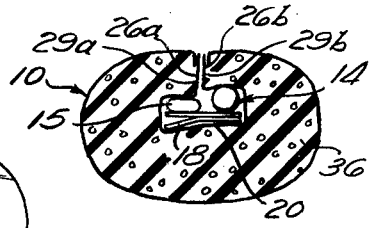
Fig. 1c
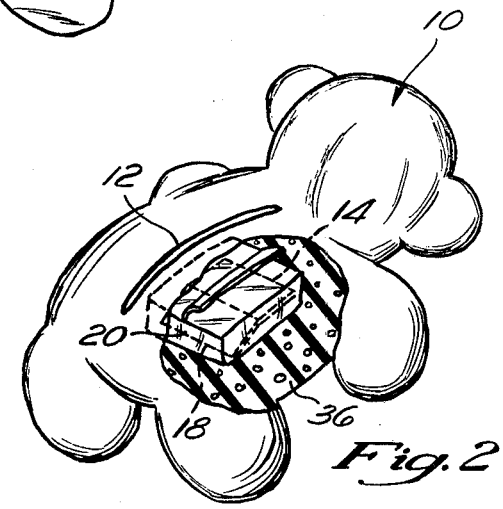
Fig. 2
Fig. 3
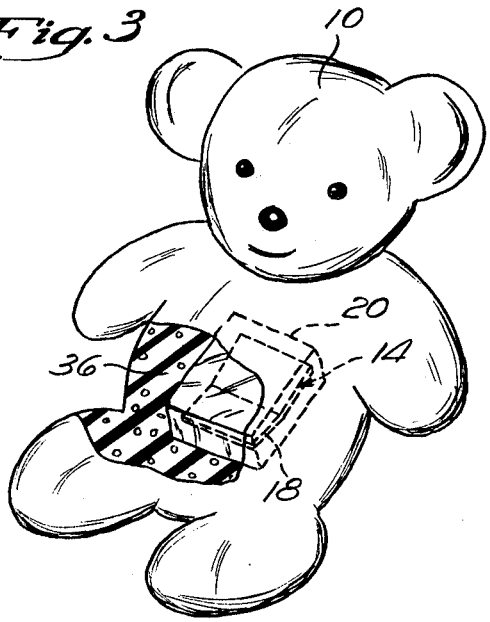
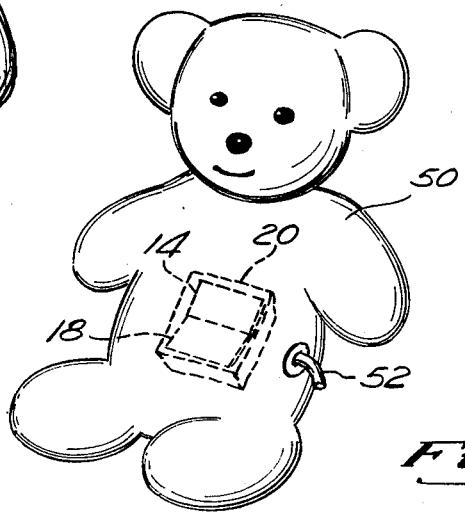
Fig. 4

CUSHIONED STRUCTURE AND METHOD OF TESTING THEREOF

BACKGROUND OF THE INVENTION (1) Field of the Invention

This invention pertains to the field of cushioned vibrating means and particularly to mounting methods and structures for self contained pressure activated vibrating means inside a cushioned means.

(2) Statement of the Prior Art

Applicant is not aware of pertinent prior art except for her own U.S. Pat. No. 4,136,685.

BRIEF SUMMARY OF THE INVENTION

Vibrating cushioned means are known in the art, as exemplified by Applicant's U.S. Pat. No. 4,136,685, issued on Jan. 30, 1979 for a self-contained (i.e., battery-operated,) pressure activated vibrating means enclosed in a cushioned means, which is hereby incorporated by reference.

The self-contained pressure activated vibrating means disclosed in that patent was shown enclosed in a pillowed cushioning means having a unitary sheet of foam rubber or similar material surrounding the vibrating means. The unitary sheet foam material, however, is relatively expensive and is difficult to form into complex shapes. Thus, a commonly used filler for complex shapes such as stuffed toy animals is e.g., shredded material, shredded foam, shredded kapok and many others. Shredded fillers have the advantage of being more economical and lend themselves to blow filling out of the outer shell or covering, as well as adapting more readily to the shape of the outer shell. However, the use of shredded fillers has been found to interfere with the proper operation of self-contained internally placed pressure activated vibrators. Loose filler material tends to work its way under the pressure activating switch plate so that it cannot be depressed to activate the vibrator disabling the latter. Thus, the vibrator should be protected, in some way, against mechanical interference by a wall impervious and impermeable to the loose filler material, yet flexible enough to allow transmission of external pressure for activating of the vibrator means.

Also, while a solid filler block of foam will provide adequate support to hold the pressure activated vibrator in proper position and be correctly oriented within the cushioning means, such support is lacking when loose, shredded filler is used and therefore separate supporting means for the vibrator means are required.

These problems have been solved by the novel structure, and associated method of this invention. The novel structure comprises an outer shell or covering affixed to an inwardly extending pocket cavity having flexible side walls and a readily closeable, first access opening formed in the outer shell in communication with a second access opening in said pocket unit through which a self-contained, pressure activated vibrator is placed into the pocket cavity and sealed. As the shell is then filled with filler material around the pocket cavity, the filler exerts pressure on the outer surface of the pocket cavity so that the flexible walls of the pocket cavity are made to substantially conform against the vibrating means contained therein—thereby providing support and retaining the same in a stable position and orientation within the loose filler.

The amount and pressure of filler material placed within the shell falls within critical limits. Overfilling will prematurely activate the pressure activated vibrator means while under filling will not permit reliable transmission of pressure from the surface of the outer shell covering to the internal pressure activated vibrator. A method of testing for the critical pressure limits is set forth.

BRIEF DESCRIPTION OF THE DRAWINGS

FIG. 1 is an exploded view of the outer shell which constitutes the form of a teddy bear, the discrete flexibly walled pocket unit, and the pressure activated self-contained vibrating means;

FIG. 1*a* is a cross section, of the empty pocket unit installed in the outer shell prior to filling of the shell;

FIG. 1*b* is a cross section of the pocket unit together with the vibrating unit in place within the pocket unit prior to filling of the shell;

FIG. 1*c* is a cross section after filling of the outer shell and showing the positioning of the vibrating means within the loose pocket unit and surrounded by filler material;

FIG. 1*d* is an enlarged fragment of the cross section of FIG. 1*a* showing the preferred form of attachment of the pocket flaps to the outer shell to construct the combined opening, which has been provided with Velcro ® fastener means;

FIG. 2 is a broken away rear view of a complete vibratory cushioned means showing the pocket unit enclosing the vibrating means within the filler material, and the elongated access opening in the outer shell;

FIG. 3 is a broken away frontal view of the vibrating cushioned means of FIG. 2 showing the outline of the flexible pocket unit encased in the filler material; and FIG. 4 is a frontal view of a vibrating cushioned means where the filler medium is a fluid such as air or water and the vibrating means is held in an impermeable pocket unit.

DETAILED DESCRIPTION OF THE INVENTION

Turning to FIG. 1 of the drawings, an empty or deflated outer shell 10 of complex geometric shape has an elongated opening or slit 12 formed in its rear side.

A pressure activated, self-contained vibrating means or vibrator 14 is shown, which may be of generally rectangular shape, among other shapes, and may be activated by applying pressure against flapper or pressure plate 18 to complete an electrical circuit to power a small vibrator motor. The vibrator unit 14 includes battery 15 and vibratory motor 17 and associated electrical circuitry (not shown). Pressure activated vibrator units are shown in U.S. Pat. No. 4,136,685 and in my continuation-in-part application Ser. No. 972,284 also incorporated herein by this reference.

A pocket unit 20 is formed of flexible material such as a textile fabric or flexible plastic sheeting, among many other possible materials, so as to define a flexible walled cavity adapted to receive vibrator 14 through an elongated slit opening 22 in one wall 24 of pocket unit 20, Pocket 20 may be advantageously provided with a pair of flaps 26*a* and 26*b*. Pocket 20 is then inserted into outer shell 10 and the flaps 26*a* and 26*b* are preferably attached to edges 29*a* and 29*b*, respectively, of opening 12 in outer shell 10, as by sewing along lines 28*a*, 28*b* as shown in FIG. 1*d*. Thus, pocket cavity 20 preferably extends inwardly to the interior of outer shell 10, as shown in FIG. 1*a*, and forms a closed cavity or compartment 30 therein, the sole means of access being through combined access opening 32, i.e., the combination of communicating openings 12 and 22 in outer shell 10 and pocket unit 20, respectively. The dimensions of cavity 30 should be somewhat oversized relative to vibrator 14 so as to form a loose pouch for the latter prior to filling of outer shell 10.

The pressure activated vibrating means 14 is then inserted into cavity 30 as shown in FIG. 1*b*, and finally, the outer shell is filled, as by known blow filling methods, through a temporary opening not shown in the drawings within a critical pressure range which is specified below. The shredded filling 36 will surround and encase the pocket unit 20 so that the latter is suspended within outer shell 10 and spaced therefrom by flaps 26*a* and 26*b*. The size of flaps 26*a* and 26*b* may be varied so as to achieve any desired spacing of the pocket unit 20 from the outer shell 10 and to create spaces 29*a* and 29*b* for filling with filler material to completely encase vibrator 14 as shown in FIG. 1*c*.

The final pressure of filling 36 should be sufficiently high so that the filling will readily transmit moderate external pressure onto the pressure plate 18 of vibrator 14. Too low a filling pressure will result in a "mushy" cushioning which will tend to absorb external pressure so that vibrator 14 can only be activated by applying force directly over pressure plate 18. Overfilling on the other hand will result in an oversensitive cushioning means where the application of a slight, accidental pressure (at most any point on outer shell 10) will activate the vibrator 14. This is undesirable, among other reasons, because the vibrator 14 may be activated accidentally during storage and cause the batteries powering the vibrator motor to run down. The ideal pressure level is that which causes activation of the pressure plate 18 upon application of a moderate, deliberate manual pressure on the general area overlying the pressure plate 18. Although this pressure has not been quantified and, in fact, will vary with different shapes, volumes, etc. of outer shell 10, and with the resistance or stiffness of the flapper or pressure sensor 18, as well as other variables which will be apparent to those skilled in the art, the proper pressure is best ascertained by repeated application of pressure, manual or otherwise, onto the desired predetermined area of the outer shell 10 during the filling operation; and stopping the filling process when the proper response is obtained to the application of external pressure. Of course, once the proper weight or volume of filler has been ascertained for a given outer shell 10 and pressure activated means 14, it may be sufficient to subsequently control the volume or weight of filler being inserted into shell 10 without the repetitive application of external pressure for testing purposes.

It follows from the just-described filling process that the vibratory means must be supplied with electrical current during the filling process for testing purposes so described herein. The electrical source may be, of course, the batteries 15 installed in normal fashion in vibrator 14. This method, however is not practical in the production of large quantities of vibratory cushioning means because it involves the steps of installing a set of batteries 15 prior to filling shell 10 and then removing batteries 15 after filling since it is generally undesirable to store or ship the vibratory cushioning means with batteries installed therein.

Since the additional steps significantly slow down production, a method of testing has been devised which includes supplying electrical power to the vibratory means within cavity 20 by means of a set of electrical contacts mounted at one end of an elongated probe means adapted for insertion into cavity 20. The electrical contacts are mounted in such spacing and orientation as to match the spacing and orientation of the battery contacts in vibrator 14. The probe mounted contacts are connected to an external power supply by means of flexible electrical conductors. Thus, an operator will insert the contact end of the probe means into cavity 20 during the filling step so as to make momentary electrical contact with the battery terminals of vibrating means 14. As soon as it is determined that the shell 10 has been filled to a pressure within the critical pressure range herein described, the probe means may be quickly withdrawn from the cavity 20 and is then immediately ready for insertion into the next vibrating means to be filled.

This novel method of supplying electrical power to a relatively inaccessible vibrator greatly speeds up the manufacture of cushioned vibrating means according to this invention.

The flexible walls of pocket or pouch 20 will closely conform to the contours of the vibrating means 14 under the pressure exerted by filling material 36 to simulate the effect of a solid filler and thus to stably retain vibrator 14 in a predetermined, optimal, orientation i.e., such that the pressure plate 18 always faces the area of outer shell 10 where external pressure is normally applied and is not readily displaced from this orientation, even after normal usage.

The encasing effect of filler 36 will in itself prevent easy removal of vibrator 14 from cavity 30. This is a safety feature designed to prevent injury to younger children and is deemed one of the features of this invention. Deliberate access by an adult into cavity 30 is not impeded by the pressure filler 36 and may be necessary for periodic replacement of batteries 15.

For further safety as well as aesthetic effect a readily manually disengageable closure means is preferably provided for access opening 32, such as Velcro ® strips 60 running along the opposing edges of the opening 32. Other fastener means, including but not limited to zippers, clasps, buttons or snaps, may be effectively substituted for the Velcro ® strips.

The pocket 20 may be formed by folding a rectangular piece of suitable material so that one pair of opposing edges are joined along a line bisecting the rectangle, and then sealing the two opposing, open sides 42*a* and 42*b* to form a pocket having an elongated access opening where the first two edges were brought together. If desired, flaps 26*a* and 26*b* may be formed simply by allowing for an excess of material before sealing the remaining open edges 42*a* and 42*b*, to form the pocket 20 of FIG. 1. Of course, pocket 20 may be formed by other methods as will be apparent to those skilled in the art.

In some embodiments of this invention, it may be desirable to restrict the combined opening 32, after vibrator 14 has been placed within cavity 30, as a further precaution against its removal by children or accidental loss. The partial closure or restriction is preferably accomplished by sewing together or otherwise sealing a portion of flaps 26*a* and 26*b* adjacent to the ends 31 of the opening 32 so as to leave a smaller, central access opening of sufficient aperture to permit replacement of batteries 15, but too small to allow passage of the vibrator 14.

It is understood that the filling medium may include fluids and liquids, such as air or water in which case the materials used for pocket unit 20 must be impermeable to such fluids in order to contain the same within shell 10 and to protect the vibrator 14. Suitable materials for such use include various flexible plastics in sheet form, heat sealed or glued along the edges to prevent leaks of the fluid medium.

An example of an air filled shell 50 incorporating the teachings of this disclosure is shown at FIG. 4, where a valve 52 has been added for filling purposes.

The response of the pressure plate 18 can be adjusted by wedging or otherwise securing a piece of resilient material underneath the plate 18, i.e., between the pressure plate 18 and the body of vibrator 14, to thereby increase the minimum pressure necessary to activate the vibrating means 14. This procedure may be particularly useful to counteract filler pressure and avoid self triggering where the shell 10 must be filled to a high internal pressure with filler material 36, for structural or other reasons. Thus, depending on the nature and thickness of the material wedged under pressure plate 18 the triggering pressure is easily and inexpensively adjustable within wide limits, eliminating the necessity of custom fabrication of the pressure activated vibrator 14 for different types of shapes and sizes of outer shells 10 and kinds of filling material 36.

Suitable materials for such wedging include foam rubber and kapok, among many others. Although the optimal thickness is best determined experimentally, it has been found that approximately ¼ inch thick by 1 inch square of foam rubber is useful with a kapok filler material 36, while a ¾ inch to 1 inch thickness of foam rubber is adequate where filler material 36 is a liquid or a gas under pressure. These dimensions are provided by way of suggested starting points only since allowances must be made for numerous variables, e.g., the size of the pressure plate and other that will be apparent to those skilled in the art.

It will be further understood that the shapes and sizes of outer shell 10, vibrator 14 and pocket unit 20 have been shown in the drawings for purposes of illustration only and those elements may vary in shape and appearance.

While the description of the invention has hereto been in terms of a self-contained pressure activated vibrator, it is imperative to note that the scope of this invention includes any pressure activated means which is activated by the application of localized external pressure on outer shell 10 and which, therefore, must be maintained in an optimal orientation within as well as sheltered from, the surrounding filler material. In general the structure and method of this invention provide a convenient and economical means for incorporating a wide variety of pressure activated means into cushioning means comprising an outer shell filled with filler material.

Thus, it is not intended that the invention be limited to vibratory means, but that it shall extend to all pressure activated devices or means which it may be desirable to incorporate into a cushioning means.

The term vibratory means or vibrator is defined to include sources of acoustic vibrations or sound waves of all wavelengths, such as mechanical or electrical pressure activated devices or means, such as music boxes, sound synthesizers, among others. Many variations within the spirit and scope of this invention will occur to those skilled in the art, therefore, applicant intends to be bound only by the claims which follow.

I claim:

1. A vibratory cushioning means comprising:

an outer shell formed with a first access opening;

a pocket unit affixed to said outer shell at said first access opening and having flexible walls extending inwardly to the interior of said outer shell and having a second access opening in communication with said first access opening of said outer shell;

a self-contained pressure activated vibratory means located within said pocket unit;

fastener means for closing said first access opening; and filler material filling the interior of said outer shell between pressure limits sufficient to substantially conform said flexible walls to said vibratory means under pressure from said filler material but of insufficient pressure to activate said vibratory means.

2. The vibratory cushioning means of claim 1 wherein said outer shell is in the form of a toy animal.

3. The vibratory cushioning means of claim 1 wherein said outer shell is a complex geometric shape.

4. The vibratory cushioning means of claim 1 wherein said fastener means for closing said first access opening is readily manually disengageable.

5. The vibratory cushioning means of claim 1, wherein said filler material is selected from the group of air, water, and solid, shredded, cushioning material.

6. The vibratory cushioning means of claim 1, wherein said pressure activated vibratory means is provided with a pressure plate for pressure activation of said vibratory means.

7. The vibratory cushioning means of claims 1, 3, 4, 5 or 6 wherein said flexible walls of said pocket unit are provided with inwardly extending flaps at said second access opening to thereby create a space between said flexible walls of said pocket unit and said outer shell for filling thereof with said filler material.

8. The vibratory cushioning means of claims 1, 2, 3, 4, 5 or 6 wherein said pocket unit is spaced from said outer shell by a pair of flaps.

9. The method for making a pressure activated cushioned vibrating means having a self contained battery operated pressure activated vibrator within an outer shell comprising the steps of installing batteries in said vibrating means prior to said filling step for testing thereof during said filling step, filling said outer shell with filler material while repeatedly applying external pressure onto a predetermined area of said outer shell until a proper vibratory response is obtained to said external pressure, stopping the filling process, and the step of removing said batteries after filling said outer shell to said critical filler pressure.

10. The vibratory cushioning means of claim 1 wherein said fastener means is selected from the group consisting of Velcro ® strips and zippers.

11. The vibratory cushioning means of claim 1 wherein said first and second communicating openings form a combined access opening, the aperture of said access opening being restricted to permanently prevent removal of said vibrating means from said pocket unit but allowing access for servicing said vibrating means.

12. The vibratory cushioning means of claim 1 wherein said filler material is a gas.

13. The vibratory cushioning means of claim 1 wherein said filler material is a liquid.

14. A cushioning means comprising:

an outer shell formed with a first access opening;

a pocket unit affixed to said outer shell at said first access opening and having flexible walls extending inwardly to the interior of said outer shell and having a second access opening in communication with said first access opening of said outer shell;

a self-contained pressure activated means located within said pocket unit;

fastener means for closing said first access opening; and filler material filling the interior of said outer shell between pressure limits sufficient to substantially conform said flexible walls to said pressure activated means under pressure from said filler material but of insufficient pressure to activate said pressure activated means.

15. A cushioning means comprising:

an outer shell formed with a first access opening;

a pocket unit affixed to said outer shell at said first access opening and having flexible walls extending inwardly to the interior of said outer shell and having a second access opening in communication with said first access opening of said outer shell;

fastener means for closing said first access opening; and filler material filling the interior of said outer shell between pressure limits sufficient to substantially conform said flexible walls to a pressure activated means placed in said pocket unit under pressure from said filler material but of insufficient pressure to activate said pressure activated means.

16. A method for determining the amount of filler medium to be placed in a pressure activated cushioned vibrating means having a self-contained battery operated pressure activated vibrator within an outer shell, which comprises the steps of: supplying electrical current to said self-contained, battery-operated vibrator by means of a set of electrical contacts connected to an external source of electrical current, said contacts being mounted at one end of an elongated probe and inserted into said outer shell for making electrical contact with the battery terminals of said self-contained vibrator, filling said outer shell with filler medium while applying external pressure onto said cushioned vibrating means until said vibrator produces a vibratory response in response to said external pressure, ceasing the filling process, and withdrawing said probe from said outer shell.

17. The method of claim 16 wherein said set of electrical contacts of said probe are spaced apart to match the spacing and orientation of the battery contacts of said battery-operated vibrator.

18. The method of claim 16 wherein the amount of said filler medium required to produce said vibratory response is measured, and successive cushioned vibratory means are filled with said measured amount of filler medium.

19. The vibratory cushioning means of claim 1 wherein said first and second communicating openings form a combined access opening into said pocket cavity.

20. A cushioning means comprising:

an outer shell formed with a first access opening;

a flexible walled pocket unit contained within said outer shell and affixed thereto, said outer shell and said pocket unit having a combined access opening communicating with the interior of said pocket unit;

a self-contained pressure activated means located within said pocket unit;

fastener means for releasably closing said access opening; and filler material filling the interior of said outer shell between pressure limits sufficient to substantially conform said flexible walls to said pressure activated means under pressure from said filler material but of insufficient pressure to activate said pressure activated means.

21. The cushioned vibrating means of claim 20 further comprising flaps extending from said pocket unit and secured to said outer shell whereby said pocket unit is suspended within said outer shell and spaced therefrom.

22. The cushioned vibrating means of claim 20 wherein the edges of said pocket access opening are attached to the edges of said outer shell opening.

23. The cushioned vibrating means of claim 20 wherein both said openings in said outer shell and in said pocket unit are elongated slits.

* * * * *